US009458007B2

(12) United States Patent
Rehmeyer

(10) Patent No.: US 9,458,007 B2
(45) Date of Patent: Oct. 4, 2016

(54) YOUTH STIRRUP ATTACHMENT FOR AN ADULT SIZE SADDLE

(71) Applicant: Bradley W. Rehmeyer, Shrewsbury, PA (US)

(72) Inventor: Bradley W. Rehmeyer, Shrewsbury, PA (US)

( * ) Notice: Subject to any disclaimer, the term of this patent is extended or adjusted under 35 U.S.C. 154(b) by 15 days.

(21) Appl. No.: 14/212,292

(22) Filed: Mar. 14, 2014

(65) Prior Publication Data

US 2014/0260125 A1 Sep. 18, 2014

Related U.S. Application Data

(60) Provisional application No. 61/786,021, filed on Mar. 14, 2013.

(51) Int. Cl.
*B68C 1/02* (2006.01)
*B68C 1/16* (2006.01)

(52) U.S. Cl.
CPC *B68C 1/16* (2013.01); *B68C 1/027* (2013.01)

(58) Field of Classification Search
CPC ..... B68C 1/027; B68C 1/16; B68C 3/00
USPC ..... 54/44.2, 47
See application file for complete search history.

(56) References Cited

U.S. PATENT DOCUMENTS 3,112,592 A * 12/1963 Schindler ..... B68C 1/027 54/44.2
3,916,604 A * 11/1975 Phipps ..... B68C 1/027 54/44.2
5,123,233 A * 6/1992 Majewski ..... B68C 1/16 54/46.1
5,212,934 A * 5/1993 Brown ..... B68C 1/027 54/46.1
2010/0064642 A1* 3/2010 Talent ..... B68C 1/027 54/44.2

* cited by examiner

*Primary Examiner* — Son T Nguyen
(74) *Attorney, Agent, or Firm* — Gerow Brill

(57) ABSTRACT

The present disclosure is directed to a device that satisfies the need for a youth/small person stirrup attachment for an adult sized saddle to accommodate needs of a youth/small person saddle without the expense of a uniquely sized saddle for the child. The attachment has: a middle portion for support of a child/youth; a front portion of the attachment coupled to an adult saddle horn; a stretchable strap coupled on a first end to a rear portion of the attachment; a second end of the stretchable strap coupled to a rear portion of the adult saddle; a bottom portion of has attachment having a friction layer between the attachment and a top layer of the adult saddle; and a pair of stirrups with each stirrup coupled to a side of the middle area of the attachment by a stirrup adjustment portion. Such an attachment enhances the safety and comfort of said child/youth while riding a horse. The attachment is easily mounted on the adult saddle by placing the frontal opening around the adult saddle horn and looping the stretchable strap around the adult saddle cantle (rear portion).

4 Claims, 17 Drawing Sheets

YOUTH STIRRUP ATTACHMENT FOR AN ADULT SIZE SADDLE

CROSS REFERENCE

This application is related to provisional application Ser. No. 61/786,021 ('021) filed on Mar. 14, 2013 entitled "Youth Stirrup Attachment For Adult-Size Saddle" and is hereby incorporated herein by reference. The '021 application was filed under pre Mar. 16, 2013 AIA rules since it was file prior to Mar. 16, 2013. This instant application is a transition application that complies with 37 CFR 1.55.

FIELD OF DISCLOSURE

The field of the disclosure is a saddle, in particular a youth/small person stirrup attachment for an adult sized saddle.

BACKGROUND OF THE DISCLOSURE

The instant application discloses youth stirrup attachment for an adult sized saddle that is: comfortable for the youthful or small user; easy to use and provides a safe use by the user. There is prior art that satisfies some of these needs, but ease of use is a reoccurring need.

For example US Patent Application 2010/00064642 ('642) published on Mar. 18, 2010 entitled "Auxiliary Horse Saddle for Children" satisfies some of these needs, however ease of use is not one of them. The '642 application describes the use of seven different straps to fasten the attachment to the adult size saddle. An auxiliary horse saddle for children is often used on different horses with different adult-sized saddles to provide a service child horseback riding. The need for a convenient, but safe mounting has been an unmet need. The '642 patent application is hereby incorporated by reference herein.

SUMMARY OF THE DISCLOSURE

The present disclosure is directed to an apparatus that satisfies the need for a youth/small person stirrup attachment for an adult sized saddle to accommodate needs of a youth/small person saddle without the expense of a uniquely sized saddle for the child.

The attachment for an adult saddle has: a middle portion for support of a child/youth; a front portion of the attachment coupled to an adult saddle horn; a stretchable strap coupled on a first end to a rear portion of the attachment; a second end of the stretchable strap coupled to a rear portion of the adult saddle; a bottom portion of the attachment includes a friction layer between the attachment and a top layer of the adult saddle; and a pair of stirrups with each stirrup coupled to a side of the middle area of the attachment by a stirrup adjustment portion. Such an attachment enhances the safety and comfort of said child/youth while riding an animal. The attachment is easily mounted on the adult saddle by placing a frontal opening around the adult saddle horn and looping the stretchable strap around the adult saddle cantle (rear portion).

Two embodiments are presented, one having a detailed attachment stirrup fastening system and a second embodiment with a less detailed attachment stirrup fastening system. Both embodiments have a front portion of the attachment coupled to an adult saddle horn; a stretchable strap coupled on a first end to a rear portion of the attachment; a second end of the stretchable strap coupled to (looped around) a rear portion of the adult saddle; a bottom portion of the attachment has a friction layer between the attachment and a top layer of the adult saddle.

A first embodiment of the attachment has a stirrup adjustment portion that includes: an outside flap; an inside flap; a stirrup adjustment device; and a stirrup support strap.

A second embodiment of the attachment has a stirrup adjustment portion includes: a first end of a stirrup support strap coupled to through a bottom side of the attachment at or near said middle area; the stirrup support strap is fed through a stirrup adjustment portion to a first side of the stirrup through to a second side of the stirrup and back to and through the adjustment device. In this second embodiment, the stirrup strap is a continuous strap from the left stirrup through a series of openings in the bottom of the attachment.

Although the present disclosure has been described in considerable detail below with reference to certain preferred embodiments thereof, other versions are possible. As an example, the EVA material used provides for soft seating area for the rider. The device may have uses as a soft seating area for an adult rider between himself/herself and the adult saddle.

BRIEF DESCRIPTION OF THE DRAWINGS

These and other features, aspect, and advantages of the present disclosure will be better understood with regard to the following description, appended claims, and accompanying drawings where:

DETAILED DESCRIPTION

As described above there is a need for a youth stirrup attachment for an adult sized saddle to accommodate needs of a youth/small person saddle without the expense of a uniquely sized saddle for a child/small person. Among the most important need for a child using the youth stirrup attachment for an adult sized saddle is the child's safety. The child and his/her parents need the assurance that the attachment will be firmly attached to the adult sized saddle and will not move around with respect to the adult sized saddle.

Each embodiment described more fully below includes: a middle portion for support for a child/youth; a frontal portion of said attachment coupled to an adult saddle horn; a stretchable strap coupled on a first end to a rear portion (cantle) of said attachment; a second end of said stretchable strap coupled to a rear portion of said adult saddle; a bottom portion of said attachment having a friction layer between said attachment and said a top layer of said adult saddle; and a pair of stirrups each coupled to a side of said middle area of said attachment by a stirrup adjustment portion.

First Embodiment

Figure 1:
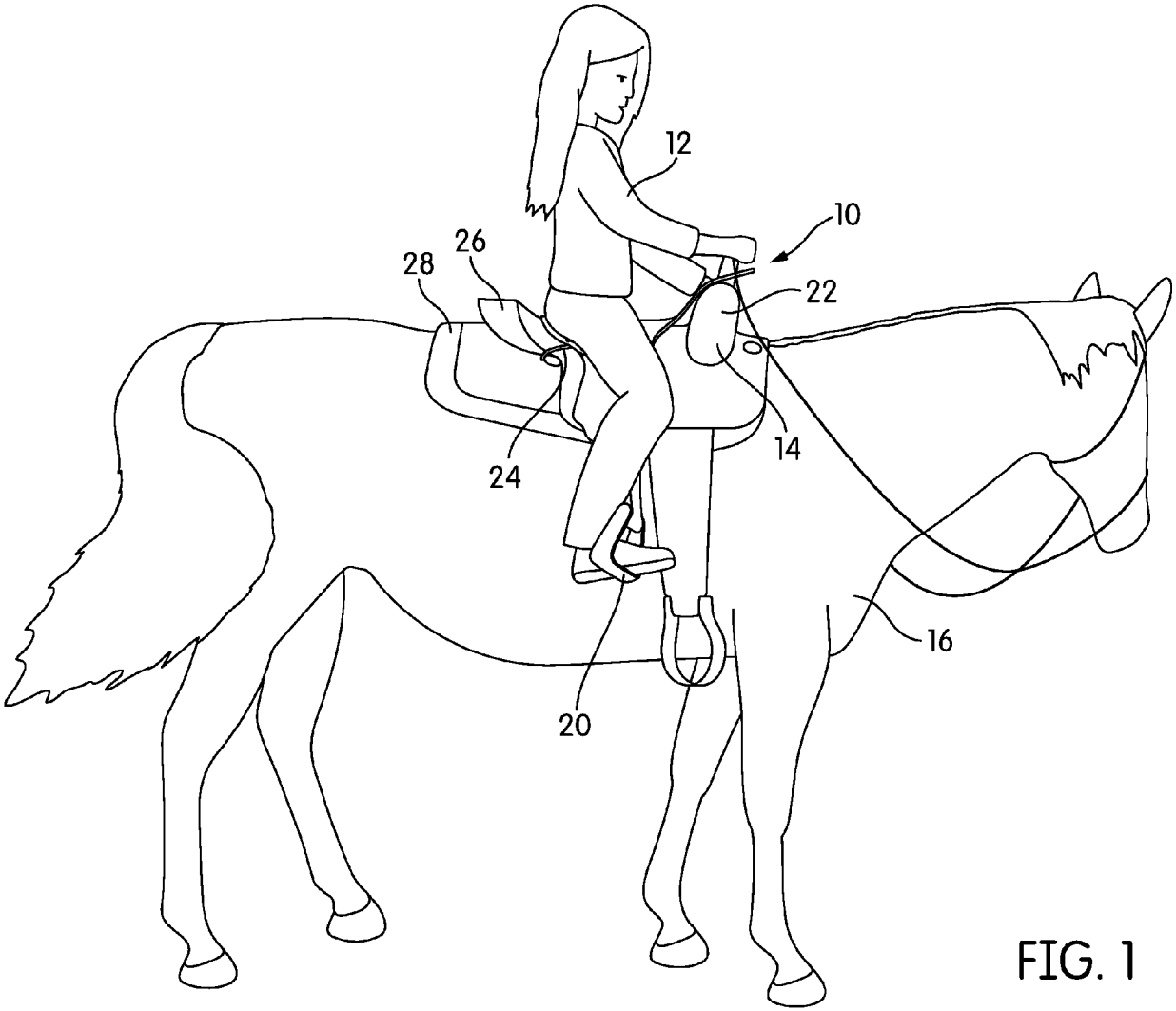
FIG. 1 illustrates a child using the first embodiment of a youth stirrup attachment to an adult sized saddle on a horse.

A first embodiment 10 of a youth stirrup attachment for a child or a small person (child) 12 is illustrated in FIG. 1 with the attachment mounted on the adult saddle 14 and the adult saddle 14 installed on a horse or other large animal 16. FIG. 1 further illustrates the adult saddle's 14 right stirrup 18; the attachment's 10 right stirrup 20; the adult saddle's horn 22; and the attachment's stretchable rear (cantle) supporting strap 24 wrapped around a rear portion (cantle) 26 of the adult saddle 14. The adult saddle 14 is placed upon blanket or other protective material 28 for the horse 16.

Figure 2:
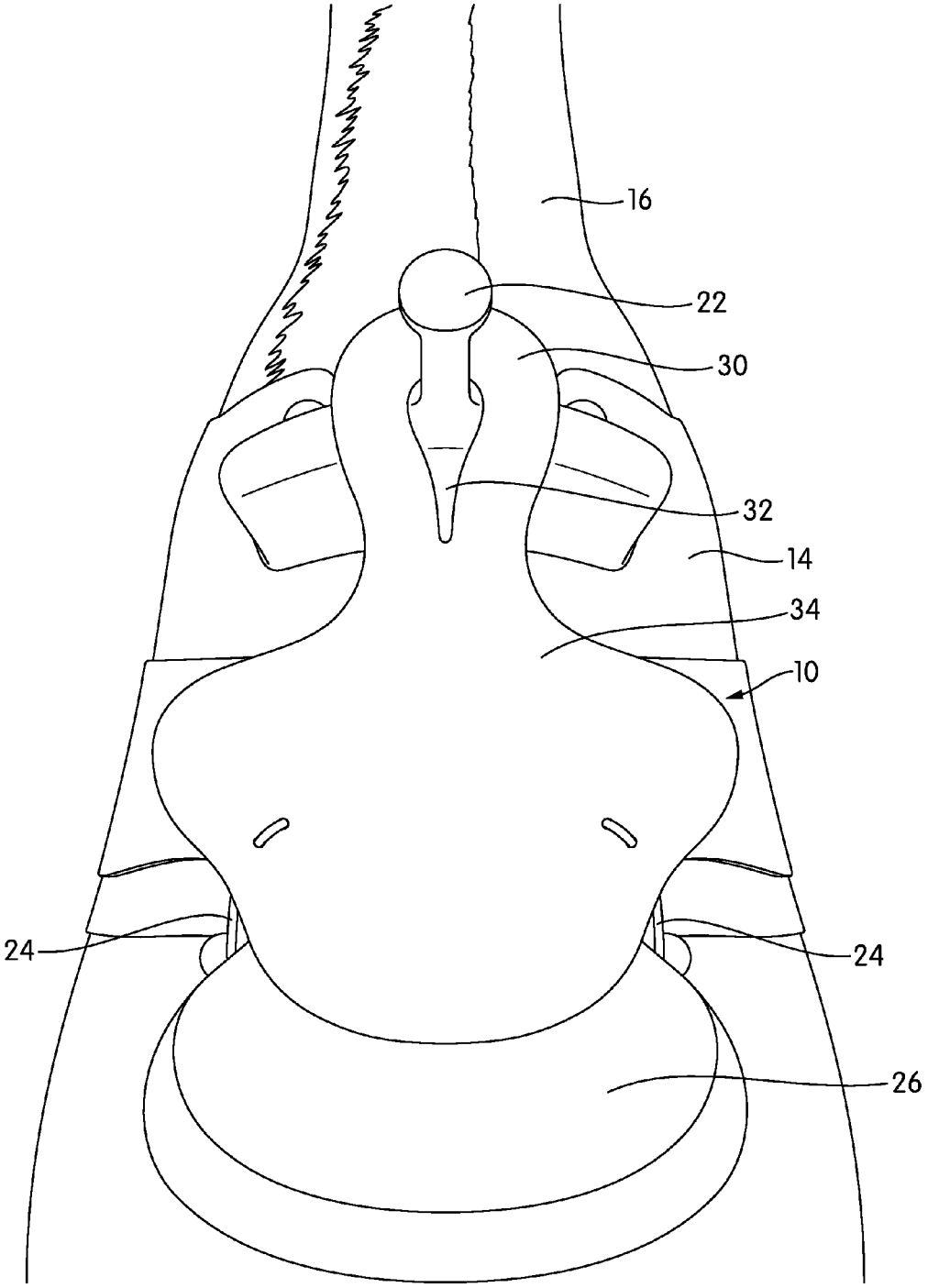
FIG. 2 illustrates a top view of the first embodiment of the youth stirrup attachment to a the adult sized saddle on a horse.

FIG. 2 illustrates a top view of the first embodiment of the youth stirrup attachment 10 with the adult saddle 14 on the horse 16. The attachment 10 is placed on top of the adult saddle 14. The forward portion of the attachment 10 has a looped area 30 with a generally open area 32 that is looped around an adult saddle horn 22. A middle area of the attachment 10 is a seating area 34 for the child 12. The attachment's stretchable rear (cantle) supporting strap 24 is wrapped around a rear portion 38 of the adult saddle 14.

Figure 3:
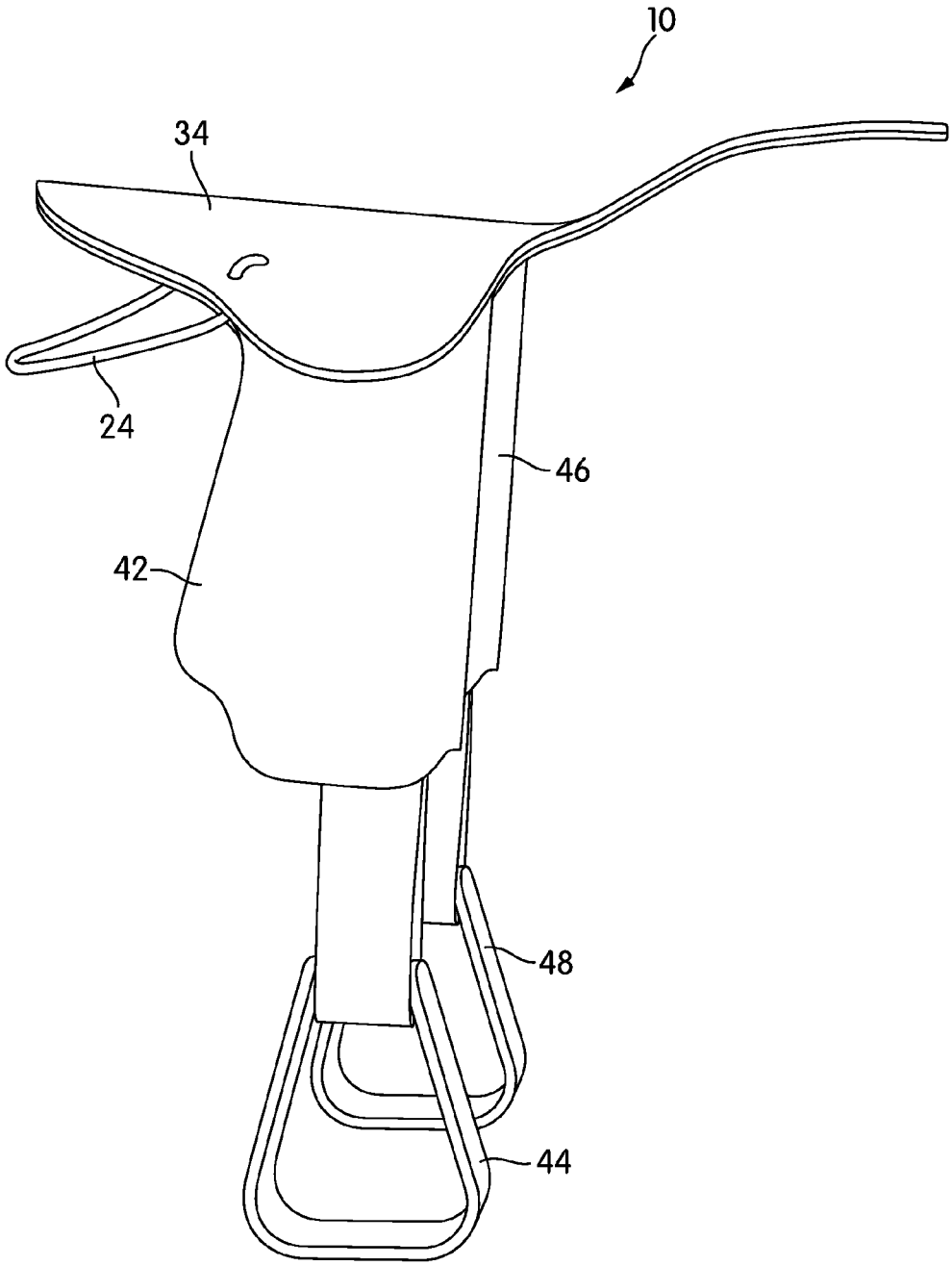
FIG. 3 illustrates of a side view of the first embodiment of the youth stirrup attachment.

FIG. 3 illustrates a right side view of the first embodiment of the youth stirrup attachment 10. As discussed above the forward portion of the attachment 10 has a looped area 30 with a generally open area 32 that is looped around an adult saddle horn 22. The middle area 34 of the attachment 10 is a seating area 34 for the rider/youth. The attachment's stretchable rear (cantle) supporting strap 24 is wrapped around a rear portion 38 of the adult saddle. A right side portion 42 of the attachment 10 provides support for the attachment's right stirrup 44. The right side portion 42 also provides an outside flap covering for a right side stirrup adjustment device (buckle) 50 (not shown in FIG. 3) and an inside flap. A left side portion 46 with its left stirrup 48 provides an outside flap covering for a left stirrup adjustment device (buckle) 52 (not illustrated in FIG. 3) and an inside flap.

Figure 4:
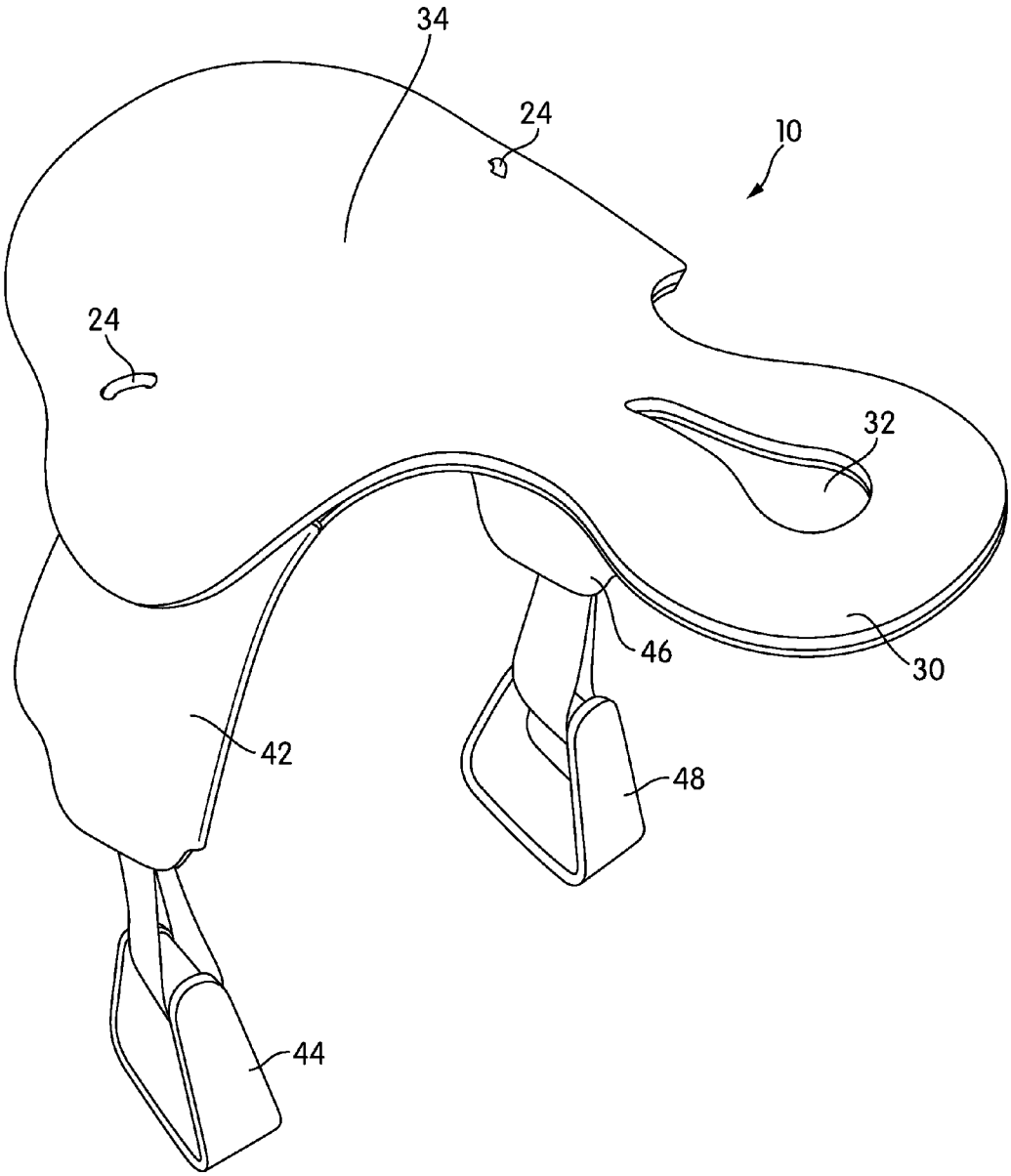
FIG. 4 illustrates a frontal isometric view of the first embodiment of the youth stirrup attachment.

FIG. 4 illustrates a frontal isometric view of the first embodiment of the youth stirrup attachment 10. As discussed above the forward portion of the attachment 10 has a looped area 30 with a generally open area 32 that is looped around the adult saddle horn 22. The middle area—seating area 34 of the attachment 10 is a seating area for the rider/youth. The attachment's stretchable rear (cantle) supporting strap 24 is coupled to the attachment rear (cantle) portion 36 and wrapped around a rear (cantle) portion 38 of the adult saddle.

As illustrated here the width of the generally open area 32 within the looped area 30 has a progressively narrower width from front to back to accommodate different sized adult saddle horns. However, certain attachment saddle combination may advantagely have the width of the generally open area 32 within the looped area 30 have a progressively narrower width from back to front to accommodate different sized adult saddle horns. The tightening of the stretchable rear (cantle) supporting strap 24 coupled to the attachment (cantle) rear portion 36 and wrapped around a rear portion 38 of the adult saddle provides the tension to keep the generally open area 32 within the looped area 30 up against the adult saddle horn 22. This combination of support keeps the youth stirrup attachment for a child fixed on to the adult saddle and provides for the safe positioning of the child on the horse.

A right side portion 40 of the attachment 10 provides support for the attachment's right stirrup 42. The right side portion 40 also provides an outside flap covering for a stirrup adjustment device 44 (not shown in FIG. 4). A left side portion 46 with its left stirrup 50 provides covering for a left stirrup adjustment device 48 (not illustrated in FIG. 4).

Figure 5:
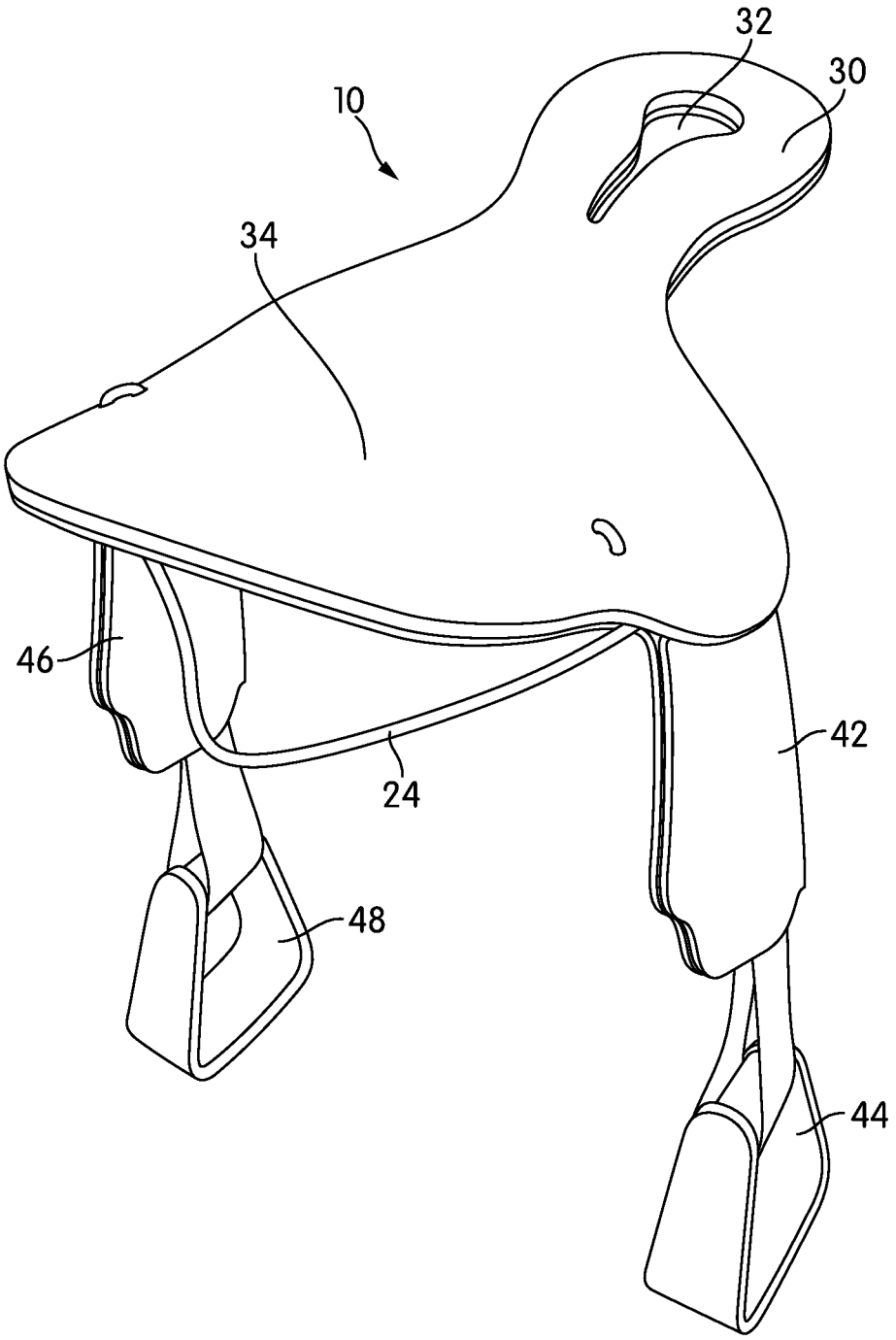
FIG. 5 illustrates a right-rear isometric view of the first embodiment of the youth stirrup attachment.

FIG. 5 illustrates a right-rear isometric view of the first embodiment of youth stirrup attachment 10 As discussed above the forward portion of the attachment 10 has a looped area 30 with a generally open area 32 that is looped around an adult saddle horn. The middle area of the attachment 10 is a seating area 34 for the rider/youth. The attachment's stretchable rear supporting strap 24 is wrapped around a rear portion of the adult saddle. A right side portion 42 of the attachment 10 provides support for the attachment's right stirrup 44. The right side portion 42 also provides a flap for covering a right stirrup adjustment device 50 (not shown in FIG. 5). A left side portion 52 also provides a flap for covering a left stirrup adjustment device 52 (not illustrated in FIG. 5).

Figure 6:
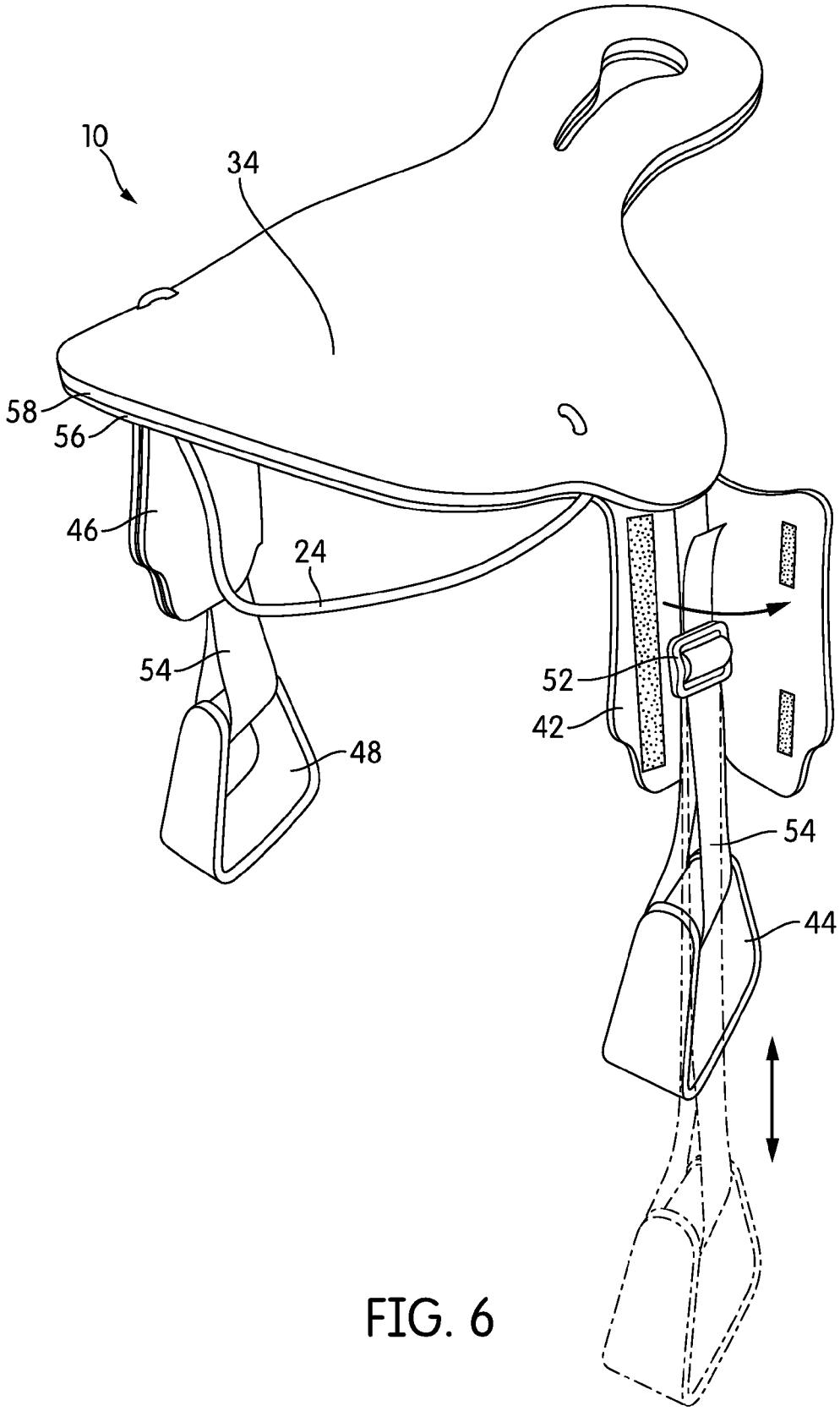
FIG. 6 illustrates a rear isometric view of the first embodiment of the youth stirrup attachment with a left adjustment area in a closed position and a right adjustment area in a position.

FIG. 6 illustrates a rear isometric view of a first embodiment of the youth stirrup attachment 10 with a left stirrup adjustment area in the outside flap in a closed position and the right stirrup adjustment area in the outside flap in an open position. As discussed above the forward portion of the attachment 10 has a looped area 30 with a generally open area that is looped around an adult saddle horn. The middle area of the attachment 10 is a seating area 34 for the rider/youth. The attachment's stretchable rear (cantle) supporting strap 24 is wrapped around a rear (cantle) portion of the adult saddle 38. A right side portion 42 of the attachment 10 provides support for the attachment's right stirrup 44. The right side portion 42 also provides covering for a stirrup adjustment device 44. A left side portion 46 with its left stirrup 48 provides covering for a left stirrup adjustment device 50 (not illustrated in FIG. 6).

The stirrups 44 and 48 are supported by a stirrup strap 54 that goes from a first side to a second side of the attachment in between a top layer 56 and a bottom layer 58 and is coupled to one or both layers with an adhesive material. Each end of the stirrup strap 54 is looped through a stirrup (Right 44 and Left 48) and fed through a buckling device (Right 60 and Left 62 to adjust a length of the stirrup strap to set and maintain a comfortable position of the stirrups for the child/user.

As discussed above and illustrated in FIGS. 4-6 the forward portion of the attachment 10 is a looped area with a generally open area 30 that is looped around an adult saddle horn. A middle area 34 of the attachment 10 is a seating area for the rider/youth. The attachment's stretchable rear supporting strap 24 is wrapped around a rear portion of the adult saddle. A right side portion 36 of the attachment 10 provides support for the attachment's right stirrup 38. The right side portion also provides covering for a stirrup adjustment device. A left side portion 46 with its left stirrup 48 serves a similar function. Fastening devices 64 fasten the stirrup adjustment device to right portion 36 of the attachment 10.

Figure 7:
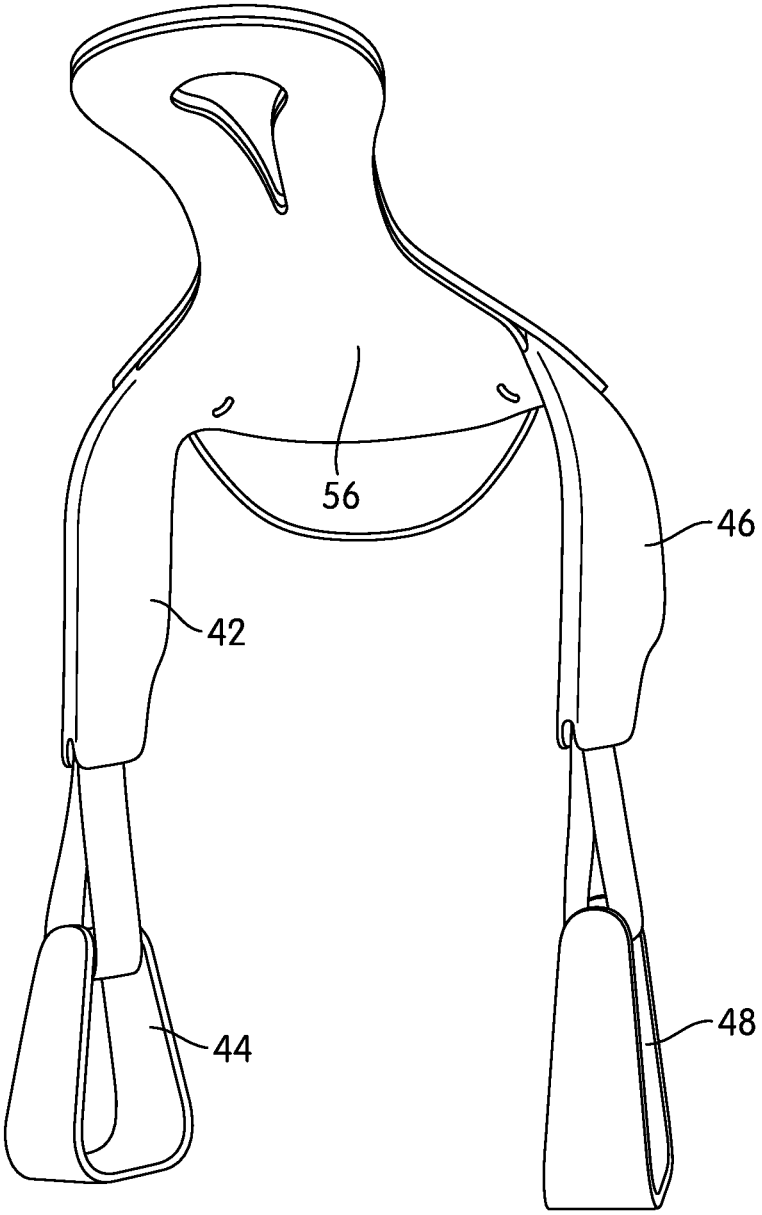
FIG. 7 illustrates a front isometric view of a first embodiment of the youth stirrup attachment illustrating an underside of the attachment.

FIG. 7 illustrates a front isometric view of the underside 52 of the first embodiment of the youth stirrup attachment with both stirrup adjustment areas 44 and 46 in a closed position.

The construction of the first embodiment of the Youth Stirrup Attachment includes two basic layers of foam material or leather. An exemplary foam material is EVA (Ethylene-vinyl acetate) foam known for its softness and flexibility. The top layer 56 is shaped as shown if FIG. 8 including the looped area 30 with a generally open area 32 and two sets of access holes 60 and 62 to accommodate the attachment's stretchable rear (cantle) supporting strap 24.

Figure 8:
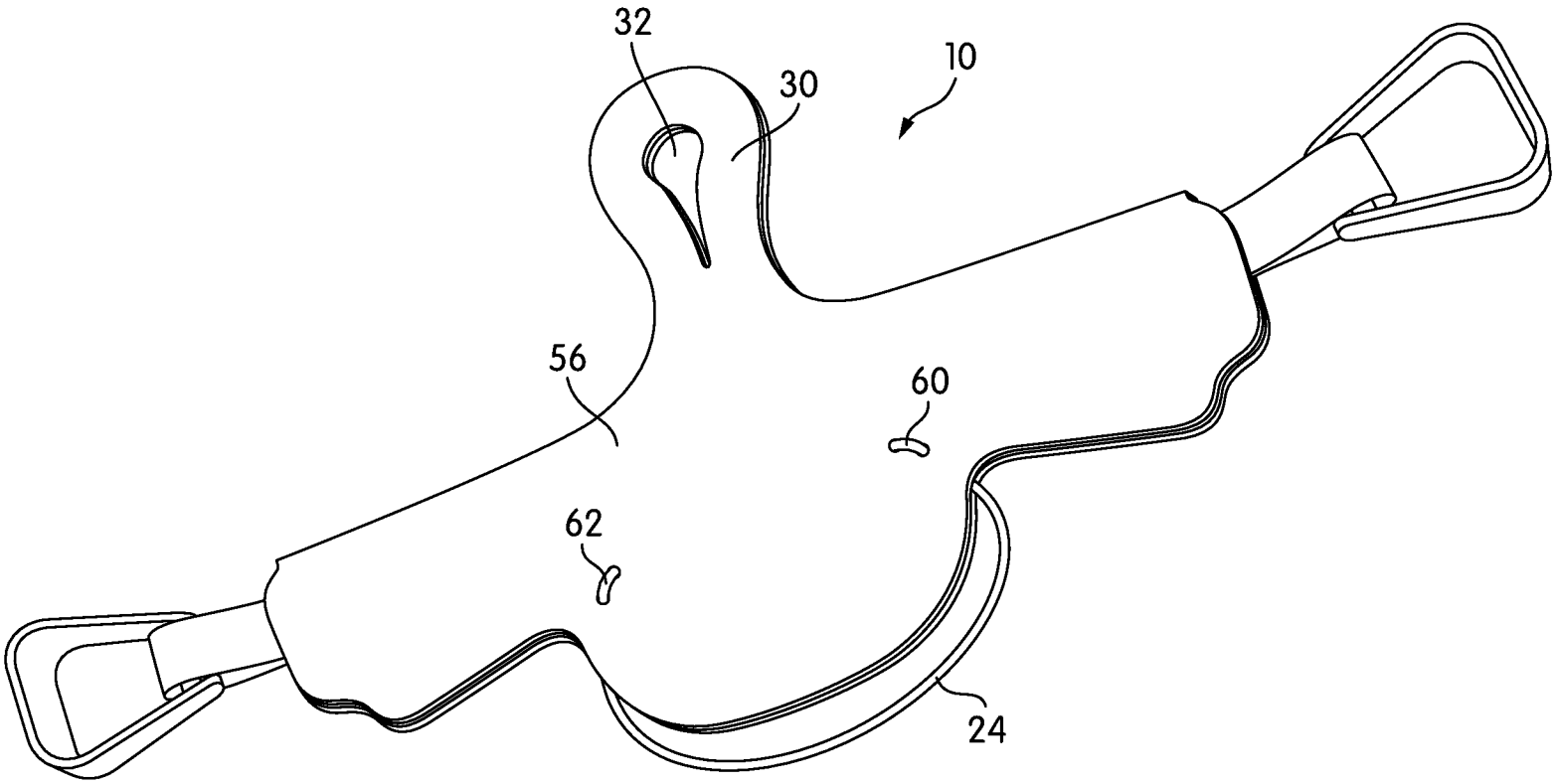
FIG. 8 illustrates a rear isometric view of the first embodiment of the youth stirrup attachment with the top area of the attachment exposed while lying flat bottom down with both stirrup adjustment devices covered.
Figure 9:
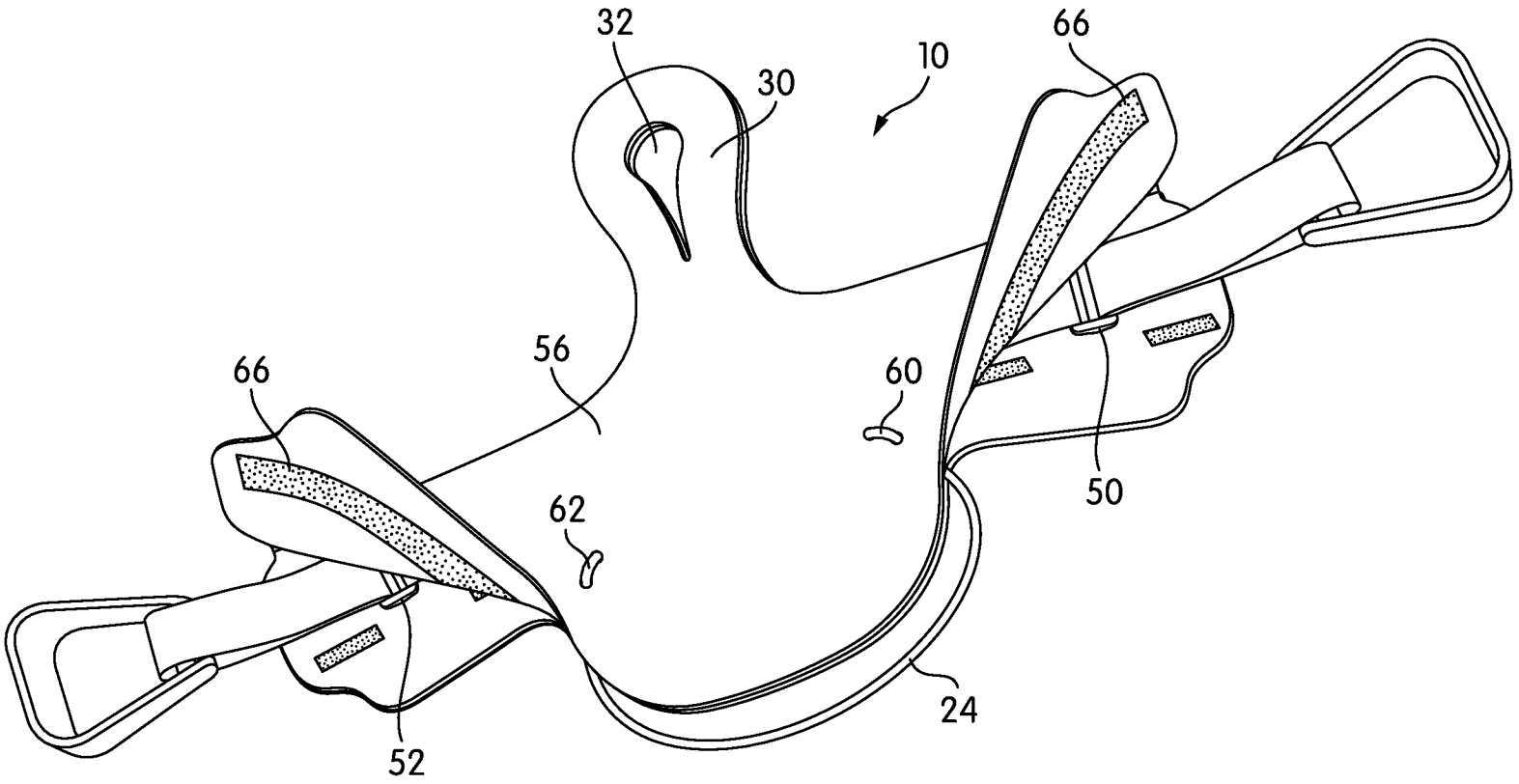
FIG. 9 illustrates a rear top view of the first embodiment of the youth stirrup attachment with the top area of the attachment exposed while lying flat bottom down with both stirrup adjustment devices covered.

The bottom layer 58 as illustrated in FIG. 9 also includes the looped area 30 with a generally open area 32 and the two sets of access holes 60 and 62 to accommodate the attachment's stretchable rear (cantle end) supporting strap 24. In addition the bottom layer includes a left side and a right sight stirrup support portions as illustrated in FIGS. 6-9. The stirrup support portions 42 and 46 are open when an adjustment to the stirrup length is needed. The stirrup support portions are held in a closed position by areas by material having complementally parts which adhere to each other when pressed together and adapted for use as a closure, fastener, or button for closing garments, curtains, or the like commonly called Velcro® 62 and 66. An upper side of each stirrup device is coupled to an upper side of the lower layer. The bottom of the upper layer and the top of the lower layer are coupled together by an adhesive in such a way that the looped area 30 with a generally open area 32 and two sets of access holes match. In the rear (cantle) area of the youth stirrup attachment, a third layer is inserted between the top layer 56 and the lower layer 58 to provide a tilted portion (cantle) at the rear as classically done with saddles.

The left stirrup adjustment device (buckle) 52 located in the in the left attachment side portion 46 provides support for the left attachment stirrup 48 and provides for an adjustment of the position of the stirrup 42 by adjusting the length of a stirrup support strap 54. The right stirrup adjustment device (buckle) 50 located in the in the right attachment side portion 42 provides support for the attachment left stirrup 42 and provides for an adjustment of the position of the stirrup 42 by adjusting the length of a stirrup support strap 54. A first end of the stirrup support strap 54 is fastened to the bottom side of the attachment 10 at or near the seating area 34. From the first end of the stirrup support strap 54, it is fed through a first adjustment device to and through a first side of a first stirrup and back up to and through the adjustment device 52. As can be seen in FIG. 6, by moving the position of stirrup support strap's 54 in the adjustment device 52, the distance of the stirrup from the rider can be adjusted. The insides of the adjustment area matching fastening devices to provide closure support for adjustment area.

FIG. 8 illustrates of a first embodiment of the youth stirrup attachment with the top layer 56 of the attachment exposed while lying flat with the bottom layer down. FIG. 8 illustrates the elements discussed above including: the looped area 30 with a generally open area 32 that is looped around an adult saddle horn 22 when on the saddle; the middle area 34 of the attachment 10 that is used as the seating area for the rider/youth; the attachment's 10 stretchable rear (cantle) supporting strap 24 wrapped around a rear portion of the adult saddle; the right and left side portion 40 and 46 of the attachment 10 providing support for the attachment's right and left stirrups 44 and 48; the right side portion 42 also provides covering for a right side stirrup adjustment device 50; the left side portion 46 also provides covering for a left side stirrup adjustment device 52. The area of the underside of the seating area for the rider/youth includes EVA foam or rubberized material fastened to the material comprising the seating area for the rider/youth. This material provides a friction element between the attachment 10 and the adult saddle 14 to reduce any movement of the attachment 10 while being used by a rider on a horse.

FIG. 9 illustrates a first embodiment of the youth stirrup attachment with the top area 56 of the attachment exposed while lying flat with the bottom layer 58 down as in FIG. 8, but with the stirrup adjustment devices (Right side 50 and Left side 52 exposed. The stirrup adjustment devices 48 located in each stirrup adjustment area provides support for a stirrup and provides for an adjustment of the position of a stirrup by adjusting the length of a stirrup support strap. A first of a stirrup support strap 54 is fastened to the bottom side of the attachment 10 at or near the seating area 34. From first end 50 of a stirrup support strap, it is fed through the adjustment device 52 to and through a first side of the stirrup 38 and back up to and through the adjustment device 48. As can be seen in FIG. 9, by moving the position of stirrup support strap's 50 in the adjustment device 52, the distance of the stirrup from the rider can be adjusted. The stirrup adjustment devices 50 and 52 are protected by the stirrup adjustment protection devices.

The construction of the first embodiment of the Youth Stirrup Attachment includes two basic layers of EVA foam or leather. The top layer is shaped as shown if FIG. 9 including the looped area 30 with a generally open area 32 and two sets of access holes 60 and 62 to accommodate the attachment's stretchable rear supporting strap 24.

The bottom layer as illustrated in FIG. 9 also includes the looped area 30 with a generally open area 32 and two sets of access holes 60 and 62 to accommodate the attachment's stretchable rear (cantle) supporting strap 24. In addition the bottom layer includes a left side and a right sight stirrup support portions as illustrated in FIGS. 6-9. The stirrup support portions 44 and 46 are open when an adjustment to the stirrup length is needed. The stirrup support portion are held in a closed position by areas by material having complementary parts which adhere to each other when pressed together and adapted for use as a closure, fastener, or button for closing garments, curtains, or the like commonly called Velcro®. An upper layer of each stirrup device is coupled to an upper side of the lower layer. The bottom of the upper layer and the top of the lower layer are coupled together by an adhesive in such a way that the looped area 30 with a generally open area 32 and two sets of access holes match. In the cantle area 26 of the youth stirrup attachment, a third layer may be inserted between the top layer and the lower layer to provide a tilted portion at the cantle as classically done with saddles.

Second Embodiment

Figure 10:
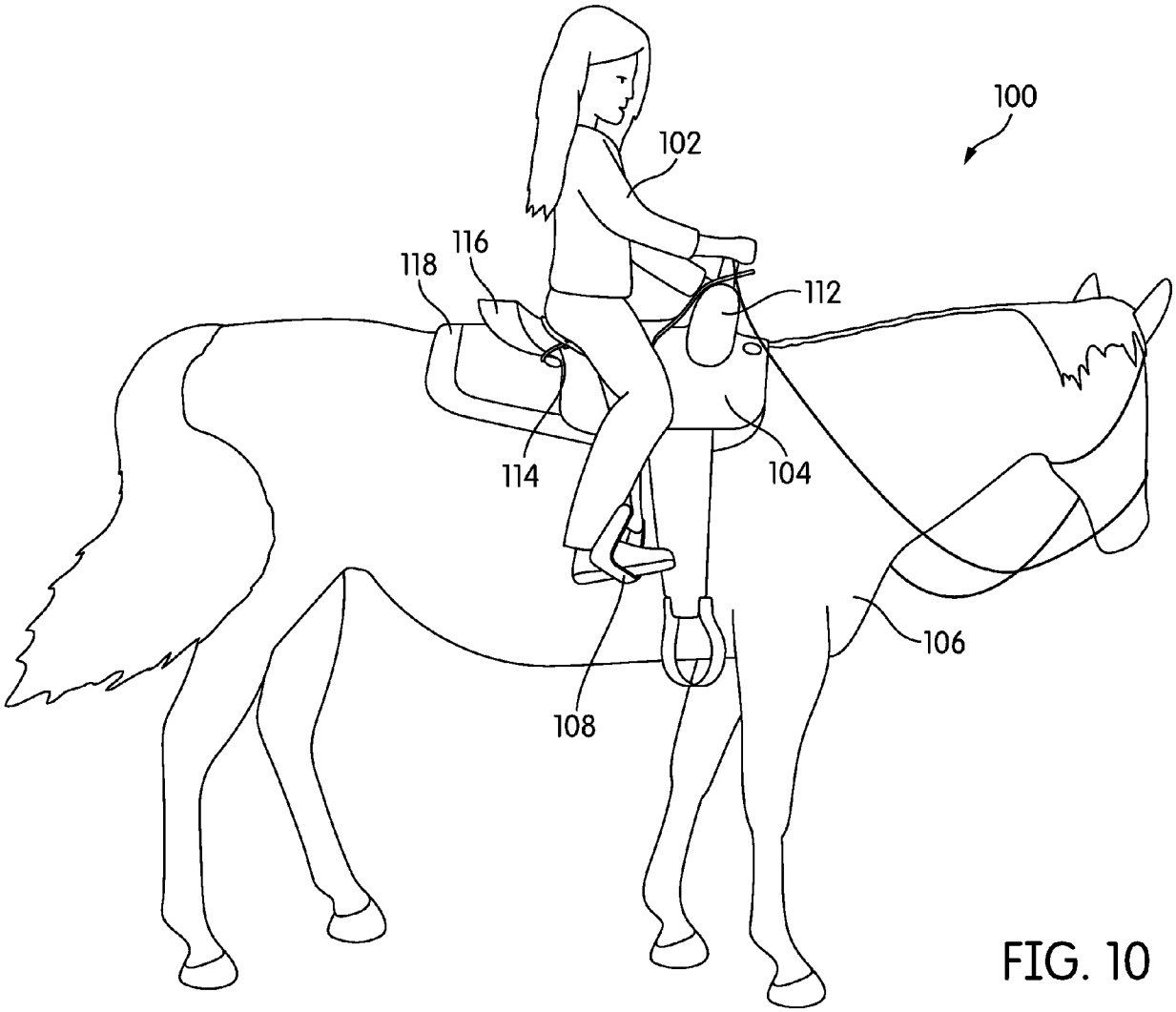
FIG. 10 illustrates a child using a second embodiment of a youth stirrup attachment to an adult sized saddle on a horse.

A second embodiment of a youth stirrup attachment 100 for a rider/youth 102 is illustrated in FIG. 10 with the attachment mounted on the adult saddle 104 and the adult saddle installed on a horse or other large animal 106. FIG. 10 further illustrates the adult saddle's stirrup 108; the attachment's right stirrup 110; the adult saddle's horn 112; and the attachment's stretchable rear (cantle) supporting strap 114 wrapped around a cantle of the adult saddle 116. The adult saddle 104 is placed upon a blanket or other protective material 118 for the horse 106.

Figure 11:
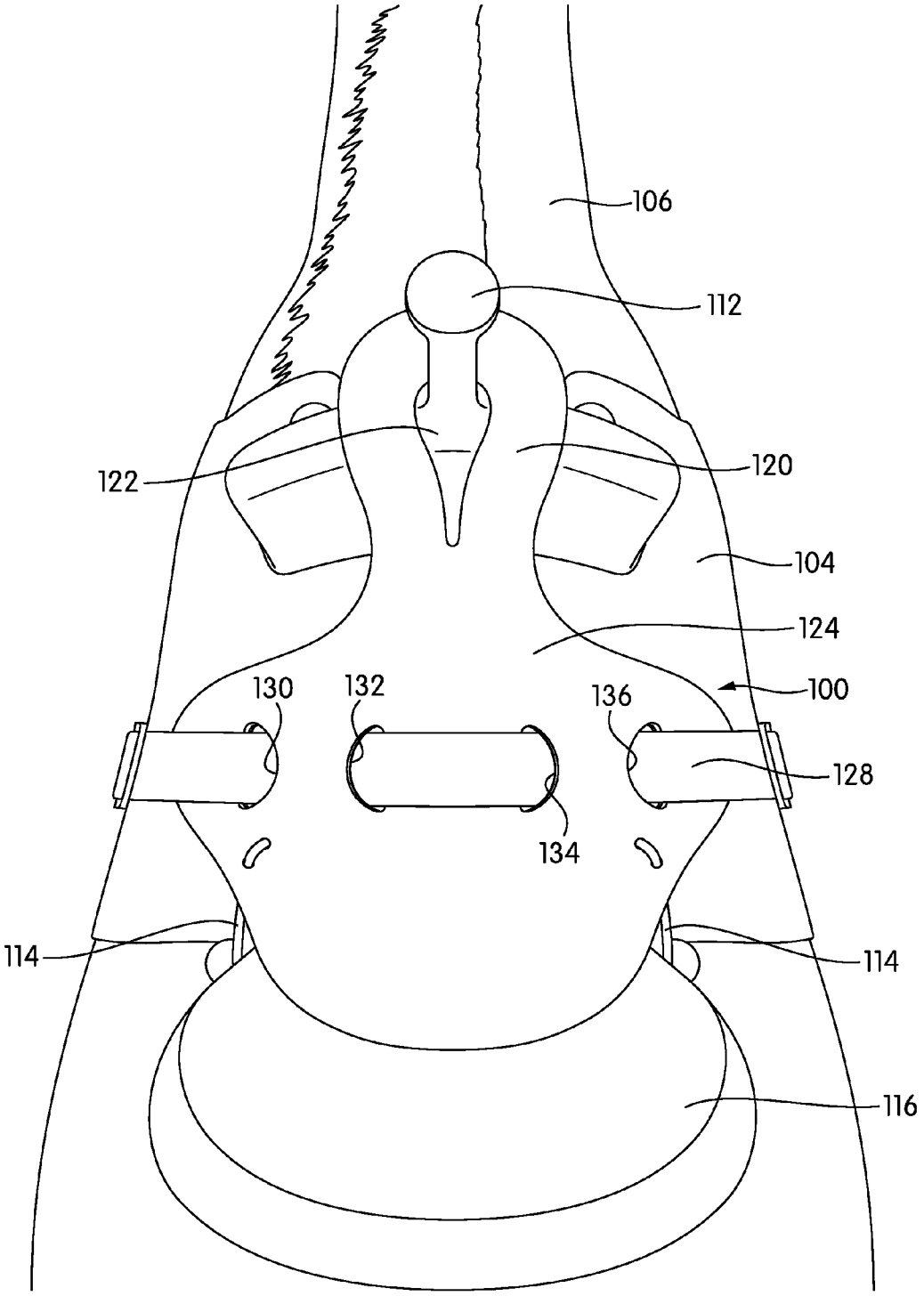
FIG. 11 illustrates a top view of the second embodiment of the youth stirrup attachment to an adult sized saddle on a horse.

FIG. 11 illustrates a second embodiment of a top view of the youth stirrup attachment 100 with the adult saddle on the horse 116. The attachment 100 is placed on top of the adult saddle 104. A forward portion of the attachment has a looped area 120 with a generally open area 122 that is looped around an adult saddle horn 112. A middle area of the attachment is a sitting area 124 for the rider/youth 102. The attachment's stretchable rear supporting strap 114 is wrapped around a cantle of the adult saddle 116. A stirrups support strap 128 is looped through a series of four openings 130, 132, 134 and 136 within the middle area of the attachment 124. The stirrups support strap 128 is coupled to the material within the area between openings 132 and 134 with an adhesive. The stirrups support strap 128 is fed under the material within the areas between openings 130 and 132 and between opening 134 and 136. The stirrups support strap 128 continues over each side of the attachment to support the stirrups as discussed further below.

Figure 12:
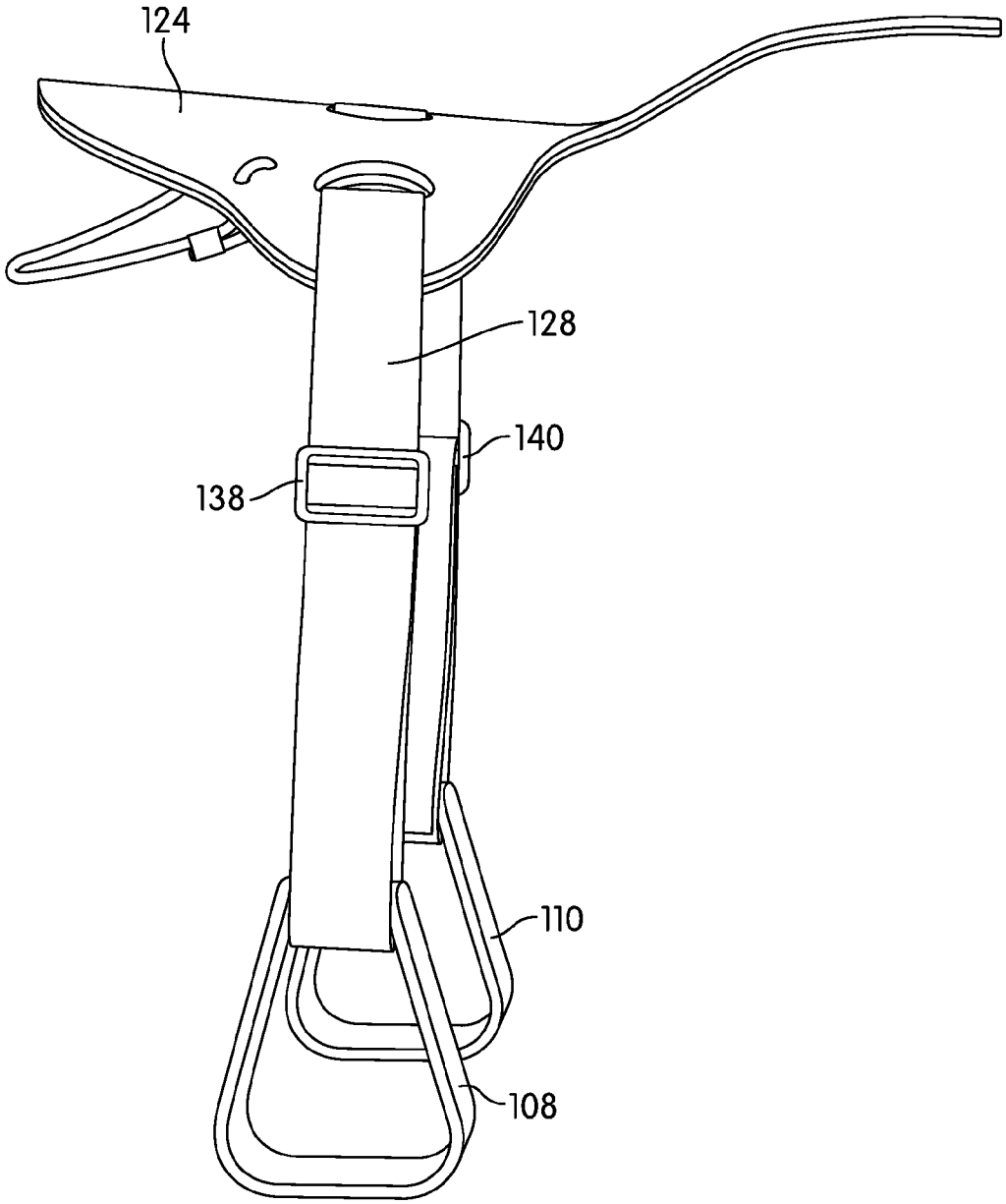
FIG. 12 illustrates a right side view of the second embodiment of the youth stirrup attachment.

FIG. 12 illustrates a side view of a second embodiment of the youth stirrup attachment 100. As discussed above, the stirrups support strap 128 is looped through a series of four openings 130, 132, 134 and 136 within the middle area of the attachment 126. The stirrups support strap progresses over each side of the attachment to support the stirrups 108 and 110. Each end of the stirrups support strap progresses through a buckle (right side 138 and left side 140) through a stirrup (right side 132 and left side 134 and back to the respective buckles.

Figure 13:
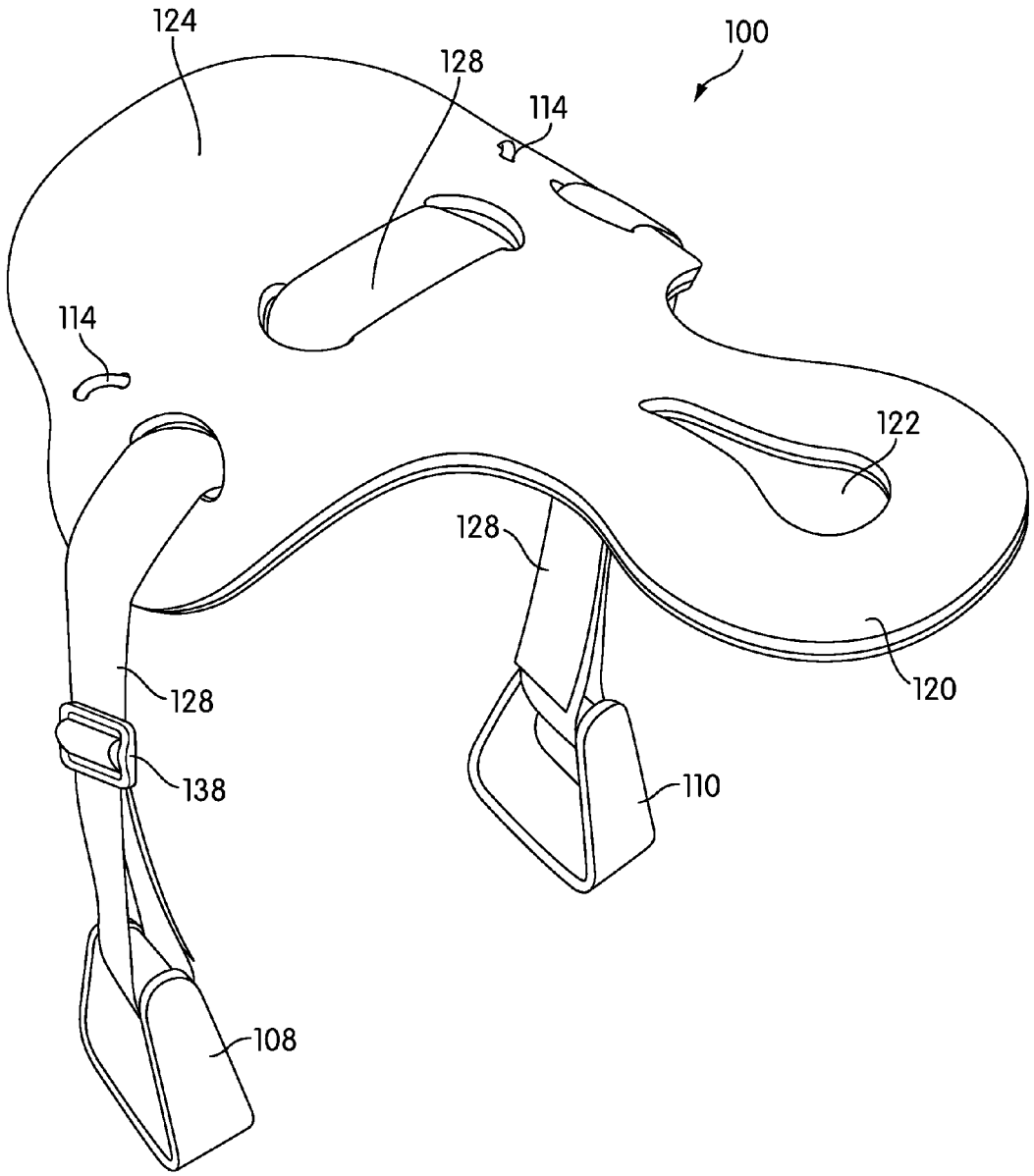
FIG. 13 illustrates a frontal isometric view of the second embodiment of the youth stirrup attachment.
Figure 14:
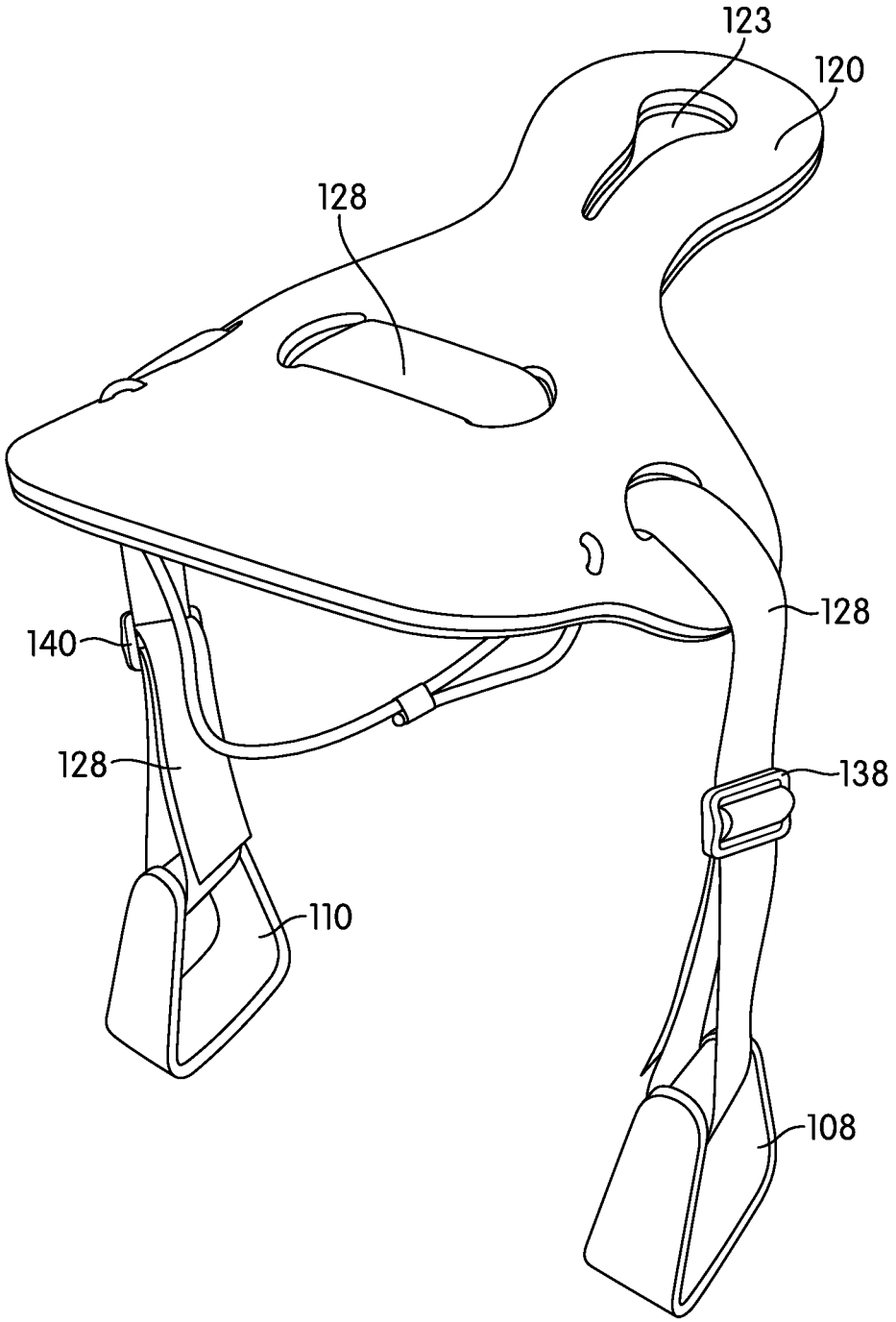
FIG. 14 illustrates a rear isometric view of the second embodiment of the youth stirrup attachment illustrating both stirrups at an upper location.
Figure 15:
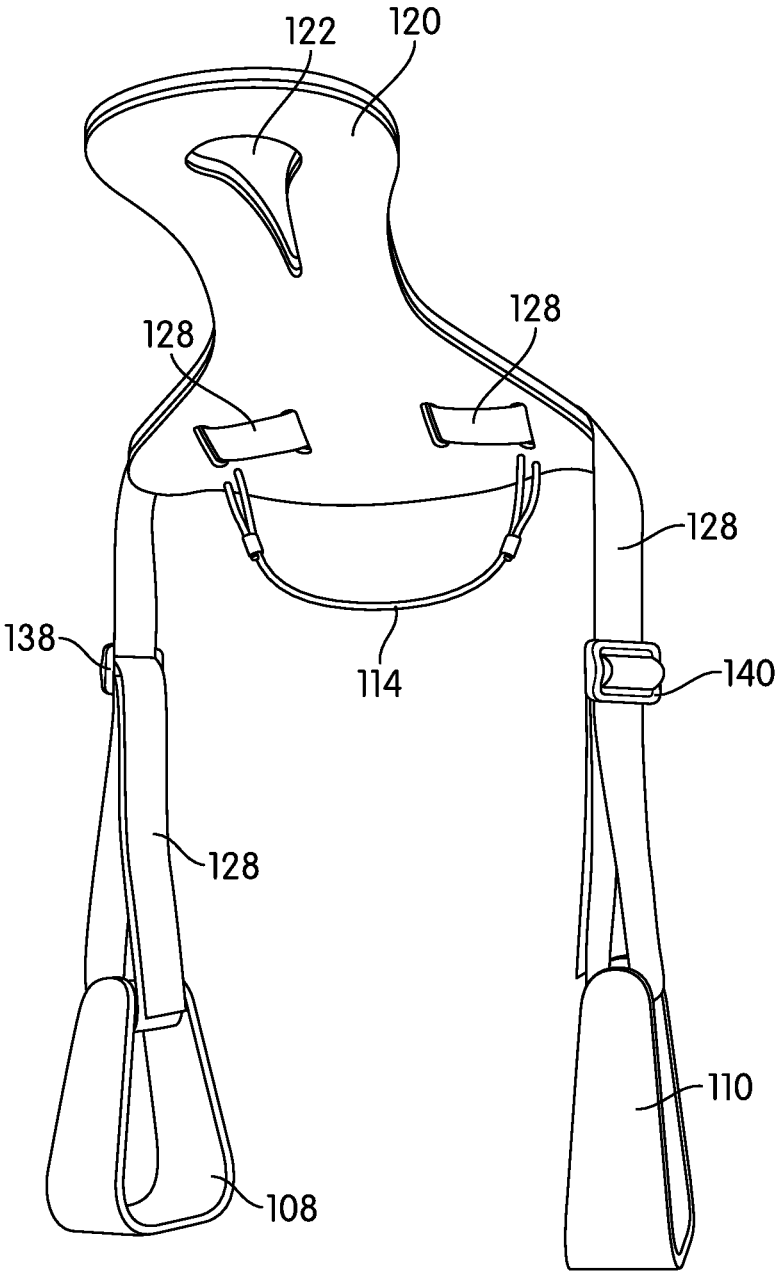
FIG. 15 illustrates a lower frontal isometric view of the second embodiment of the youth stirrup attachment with both stirrups at an identical level.
Figure 16:
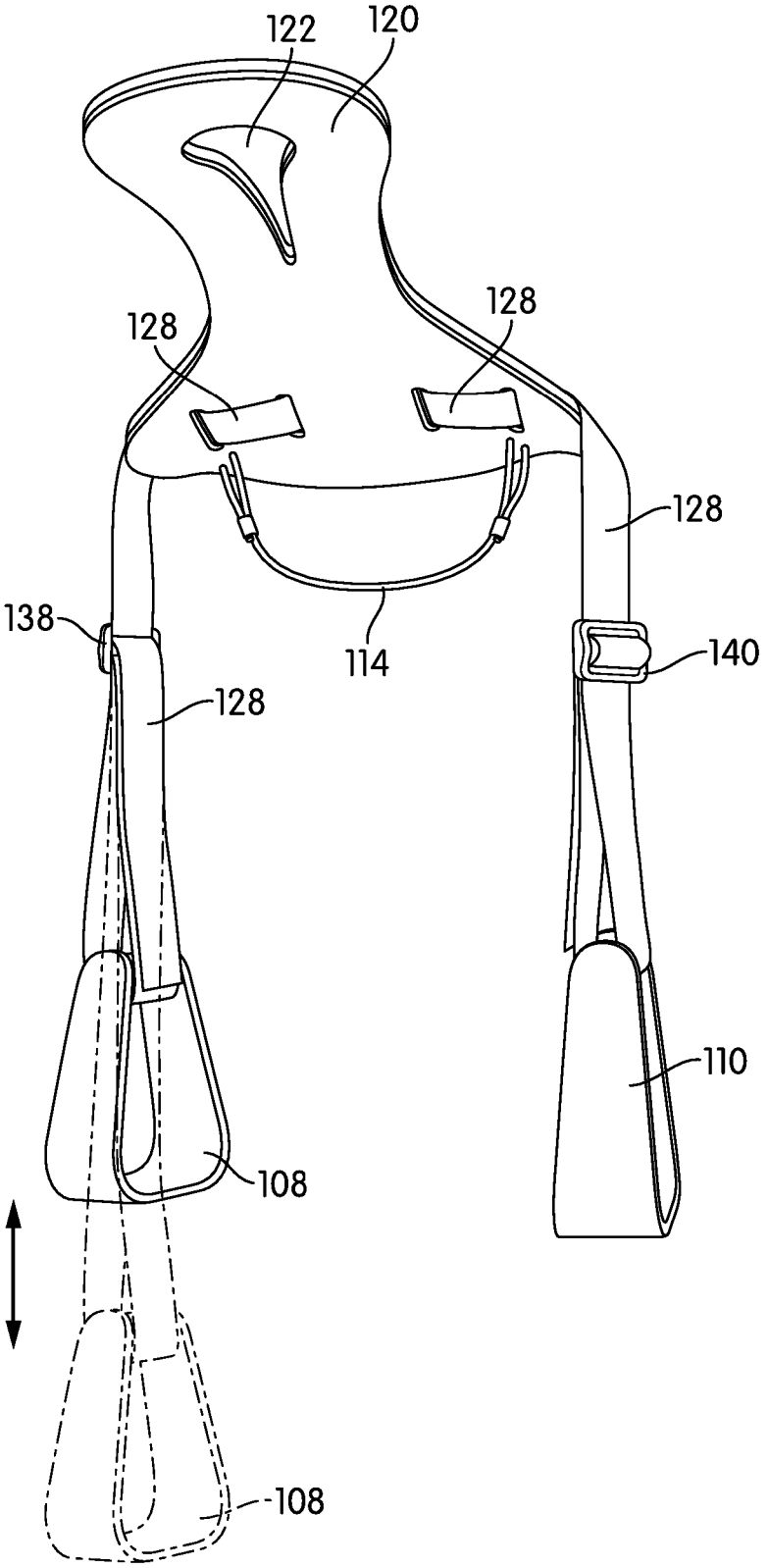
FIG. 16 illustrates a lower frontal isometric view of the second embodiment of the youth stirrup attachment with a left stirrups being adjusted to a lower level.

FIGS. 13 through 16 illustrate various isometric views of the second embodiment of the youth stirrup attachment including: FIG. 13 illustrates a frontal isometric view; FIG. 14 illustrates a rear isometric view illustrating both stirrups at an upper location; FIG. 15 illustrates a lower frontal isometric view with both stirrups at an identical level; FIG. 16 illustrates a lower frontal isometric view a left stirrups being adjusted to a lower level.

Figure 17:
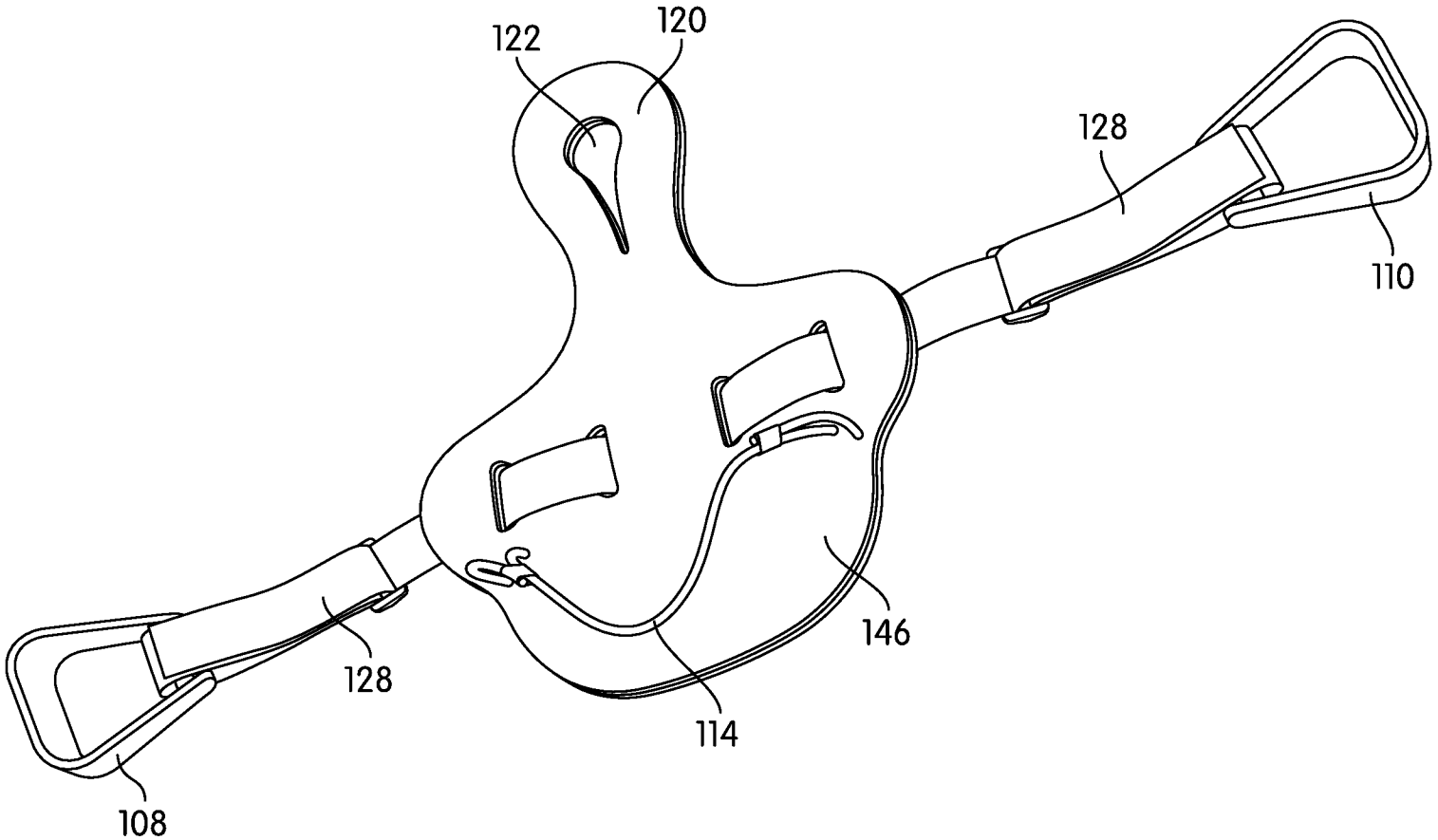
FIG. 17 illustrates a top view of the second embodiment of the youth stirrup attachment with the top area of the attachment exposed while lying flat bottom down with both stirrups extended outwardly.

FIG. 17 illustrates the second embodiment of the youth stirrup attachment with the bottom area 146 of the attachment exposed while lying flat with the top area 148 down. FIG. 17 illustrates the elements discussed above including: the looped area 120 with a generally open area 122 that is looped around an adult saddle horn 112 when on the saddle; the middle area 124 of the attachment 100 that is used as the seating area for the rider/youth; the attachment's 100 stretchable rear supporting strap 114 wrapped around a cantle portion of the adult saddle; the right and left side portion 108 and 110 of the attachment 100 providing support for the attachment's right and left stirrups 142 and 144 The area of the underside of the seating area for the rider/youth includes EVA foam or rubberized material fastened to the material comprising the seating area for the rider/youth. This material provides a friction element between the attachment 100 and adult saddle 104 to reduce any movement of the attachment 100 while being used by a rider on a horse.

An important feature of both embodiments is the three areas providing support of each embodiment of the attachment on to an adult saddle. The first support is the frontal support provided by the saddle's horn with the looped area fixed around the horn. A second support is provided by the tightening of the stretchable rear supporting strap coupled to the attachment rear portion and wrapped around a cantle portion of the adult saddle that provides the tension to keep the generally open area within the looped area at the front of the attachment up against the adult saddle horn. The third element of support is provided the roughened nature of the material on the bottom of the embodiment that provides for a measure of friction between the bottom of the attachment and the adult saddle. These elements provide a level of safety in the mounting of the attachment to the adult saddle provides the needed child safety element when using a youth stirrup attachment This combination of support keeps the youth stirrup attachment for a child fixed on to the adult saddle and provides for the safe positioning of the child on the horse.

The combination of the frontal support provided by the saddle's horn with the looped area fixed around the adult saddle horn and the support provided by the tightening of the stretchable rear supporting strap coupled to the attachment rear portion and wrapped around a cantle portion of the adult saddle that provides the tension to keep the generally open area within the looped area at the front of the attachment up against the adult saddle horn. Both embodiments provide for the safety needed withy an ease of installation of the attachment to the adult saddle. The installer needs only place the front opening around the adult saddle horn and pull the stretchable rear supporting strap coupled to the attachment rear portion and wrap it around a cantle portion of the adult saddle. This is far more convenient than having to adjust multiple straps when the attachment is moved from a first adult saddle to a second one at no price to safety of the child using the attachment.

Since the attachment stirrup may be high up on the horse for a child, the preferred method for mounting a horse having an adult saddle with an attachment is to place or have placed his/her first foot into the adult saddle stirrup followed by grabbing the adult saddle horn and once fully on the attachment, placing his/her feet in the attachment stirrups.

Although the present disclosure has been described in considerable detail with reference to certain preferred embodiments thereof, other versions are possible. As an example, the EVA material provides for soft seating area for the rider. The device may have uses as a soft seating area for an adult rider between himself/herself and the adult saddle. Therefore, the spirit and scope of the appended claims should not be limited to the description of the preferred versions contained herein.

I claim:

1. An attachment for an adult saddle comprising:

an area for support for a child/youth;

an upper layer;

a lower layer;

each layer includes a specifically shaped opening within a frontal portion of said attachment configured to surround an adult saddle horn;

each layer includes a right flap portion and a left flap portion;

a stretchable strap coupled on a first end to a first rear portion of said upper layer of said attachment and a second end of said stretchable strap coupled to a second rear portion of said upper layer of said attachment with a middle area of said stretchable strap configured to couple around a cantle of said adult saddle;

said lower layer of said attachment having a friction layer between said attachment and a top layer of said adult saddle;

a pair of stirrups each coupled to a side of said middle area of said attachment by a stirrup adjustment device and coupled to each by a stirrup support strap located between said upper layer and said lower layer;

each said stirrup adjustment device is located within said flap portion in between a fixed said lower flap and an openable said upper flap;

said each stirrup adjustment device is available for stirrup position adjustment when said upper layer flap is open;

wherein said use of said specially shaped opening of said frontal portion with said adult horn along with said stretchable strap coupled around said cantle of said adult saddle permits easy use of said attachments with multiple adult saddles; and further wherein said attachment enhances the safety and comfort of said child/youth while riding an animal.

2. The device of claim 1 wherein said stirrup adjustment portion further comprises:

a first end of each stirrup support strap fed through said stirrup adjustment device to a first side of said stirrup through to a second side of said stirrup and back to and through said stirrup adjustment device.

3. The device of claim 2 wherein an inside of said outside flap and an inside of said inside flap have one or more matching flap fastening devices to cover said stirrup adjustment device.

4. The device of claim 3 wherein said stirrup adjustment device provides for the adjustment of the distance between said attachment seating area and said stirrup position.

* * * * *